US005372176A

United States Patent [19]

Brown et al.

[11] Patent Number: 5,372,176

[45] Date of Patent: Dec. 13, 1994

[54] METHOD AND APPARATUS FOR PRODUCING HOUSING HAVING A CAST-IN-PLACE INSERT USING LOST FOAM PROCESS

[76] Inventors: Peter W. Brown, 6947 N. Club Cir. East, Hartland, Wis. 53029; Russell J. VanRens, 2380 S. Root River Pkwy., Milwaukee, Wis. 53227

[21] Appl. No.: 216,770

[22] Filed: Mar. 23, 1994

Related U.S. Application Data

[63] Continuation of Ser. No. 694,953, May 1, 1991, abandoned.

[51] Int. Cl.[5] ..... B22D 19/00; B22C 9/04

[52] U.S. Cl. ..... 164/34; 164/98; 164/45; 164/249; 164/246; 164/334

[58] Field of Search ..... 164/34, 35, 36, 45, 164/98, 249, 235, 246, 332, 334

[56] References Cited

U.S. PATENT DOCUMENTS

| | | | |
|---|---|---|---|
| 2,830,343 | 4/1958 | Shroyer | 164/34 |
| 3,946,697 | 3/1976 | Hackbarth et al. . | |
| 4,031,699 | 6/1977 | Suga et al. | 60/282 |
| 4,077,458 | 3/1978 | Hayashi et al. | 164/11 |
| 4,079,588 | 3/1973 | Yoshimura et al. | 60/278 |
| 4,086,763 | 5/1978 | Matsushita et al. | 60/282 |
| 4,109,463 | 8/1978 | Itakura et al. | 60/282 |
| 4,114,373 | 9/1978 | Sakai et al. | 60/282 |
| 4,123,902 | 11/1978 | Iida | 60/282 |
| 4,148,352 | 4/1979 | Sensui et al. | 164/112 |
| 4,167,207 | 9/1979 | Rao et al. | 164/9 |
| 4,195,478 | 4/1980 | Rao et al. | 60/282 |
| 4,197,899 | 4/1980 | Ernest | 164/34 |
| 4,206,598 | 6/1980 | Rao et al. | 60/282 |
| 4,243,093 | 1/1981 | Nieman | 164/34 |
| 4,254,621 | 3/1981 | Nagumo | 60/282 |
| 4,329,843 | 5/1982 | Inoue et al. | 60/274 |
| 4,430,856 | 2/1984 | Niedert | 60/272 |
| 4,691,754 | 9/1987 | Trumbauer et al. | 164/34 |
| 4,942,915 | 7/1990 | Kallen et al. | 164/34 |
| 4,972,674 | 11/1990 | Yamada et al. | 60/323 |
| 5,038,847 | 8/1991 | Donahue et al. . | |

FOREIGN PATENT DOCUMENTS

| | | | |
|---|---|---|---|
| 2643578 | 8/1990 | France . | |
| 0305653 | 5/1988 | Germany . | |
| 0133161 | 5/1990 | Japan | 164/98 |
| 2187251 | 7/1990 | Japan . | |
| 219331 | 2/1988 | United Kingdom . | |
| PCT/US78/-00134 | 11/1978 | WIPO . | |

*Primary Examiner*—Kurt C. Rowan
*Assistant Examiner*—Erik R. Puknys

[57] ABSTRACT

A method for casting a housing and insert assembly including a housing and a cast-in-place insert. The casting method comprises the steps of providing a prefabricated insert, surrounding the insert with an evaporable foam pattern to form a pattern and insert assembly, and utilizing the pattern and insert assembly in a lost foam casting process wherein the pattern is replaced by a material to form the housing and insert assembly.

11 Claims, 1 Drawing Sheet

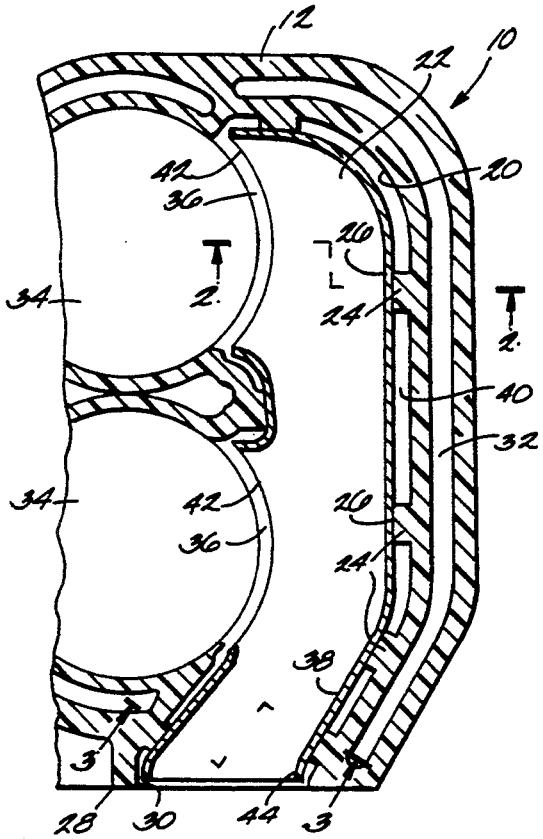
Fig. 1
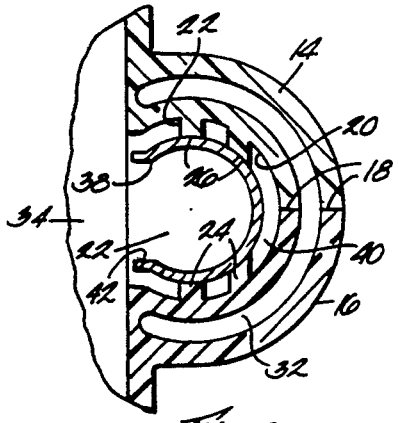
Fig. 2
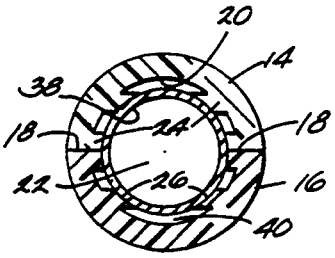
Fig. 3
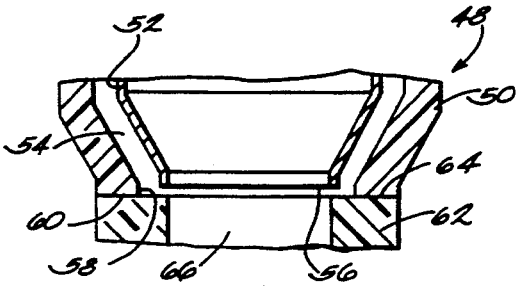
Fig. 4
Fig. 5
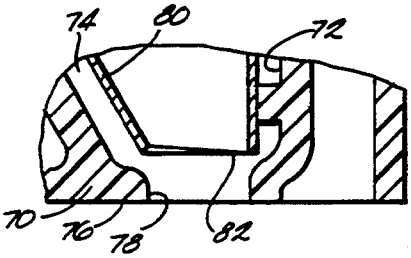

METHOD AND APPARATUS FOR PRODUCING HOUSING HAVING A CAST-IN-PLACE INSERT USING LOST FOAM PROCESS

This is a continuation of co-pending application Ser. No. 694,953, filed May 1, 1991 now abandoned.

BACKGROUND OF THE INVENTION

FIELD OF THE INVENTION

The present invention relates generally to the production of housing and insert assemblies, and more particularly to a method employing a foam pattern and insert assembly utilized in a lost foam casting process for producing an engine block having a cast-in-place insert.

REFERENCE TO PRIOR ART

It is generally known to incorporate inserts into larger molded or cast parts. Such inserts include liners installed in internal passages of cast housings. For example, metallic or ceramic liners which can be of a single or multiple layer design are commonly provided in the exhaust passages or ports of an internal combustion engine to insulate exhaust gases from the relatively cool exhaust passage walls. In some arrangements the exhaust passage liner is fitted within the exhaust passage so that the outer periphery of the liner directly contacts and is encased by the exhaust passage wall. An example of this construction is illustrated in U.S. Pat. No. 4,167,207 issued Sep. 11, 1979 to Rao et al. In other arrangements an insulating air space is provided between the liner and the exhaust passage wall by beads or teats extending from the exhaust passage wall and contacting the outer periphery of the liner. An example of an exhaust passage and liner arrangement incorporating an air space is illustrated in U.S. Pat. No. 4,031,699 issued Jun. 28, 1977 to Suga et al.

It is known to insert a liner into the exhaust passage of a prefabricated engine block during engine assembly. Fasteners, weldments or other mechanical means are commonly required to secure the insert-type liner within the exhaust passage.

It is also known to cast a liner into the exhaust passage of the engine block by encasing the liner in sand to form a liner core and positioning the liner core in a die. After the engine block is cast around the liner core the sand is removed to provide the insulating air space. Examples of engine blocks including cast-in-place inserts are illustrated in U.S. Pat. No. 4,031,699, U.S. Pat. No. 4,148,352 issued Apr. 10, 1979 to Sensui et al. and U.S. Pat. No. 4,077,458 issued Mar. 7, 1978 to Hayashi et al.

Attention is also directed to the following U.S. Patents:

| U.S. Pat. No. | Inventor | Issued |
|---|---|---|
| 4,079,588 | Yoshimura et al. | March 21, 1978 |
| 4,086,763 | Matsushita et al. | May 2, 1978 |
| 4,109,463 | Itakura et al. | August 29, 1978 |
| 4,114,373 | Sakai et al. | September 19, 1978 |
| 4,123,902 | Iida | November 7, 1978 |
| 4,195,478 | Rao et al. | April 1, 1980 |
| 4,206,598 | Rao et al. | June 10, 1980 |
| 4,254,621 | Nagumo | March 10, 1981 |
| 4,329,843 | Inoue et al. | May 18, 1982 |
| 4,430,856 | Niedert | February 14, 1984 |

SUMMARY OF THE INVENTION

The invention provides a method for casting a housing and insert assembly including a housing and an insert surrounded by the housing, the method comprising the steps of providing the insert, surrounding the insert with an evaporable foam pattern to form a pattern and insert assembly, and utilizing the pattern and insert assembly in a lost foam casting process wherein the pattern is replaced by a material to form the housing and insert assembly.

The invention also provides a pattern and insert assembly comprising an insert and an evaporable foam pattern assembly surrounding the insert and including a plurality of sections joined together around the insert.

The invention also provides a method for casting an engine block assembly including an engine block having an interior passage wall defining an exhaust passageway and having thereon a plurality of projections and an exhaust passageway liner surrounded by the engine block and supported in the exhaust passageway by the projections and in inwardly spaced relation to the interior passage wall so as to form between the exhaust passage liner and the interior passage wall an exhaust gas insulating cavity. The method comprises the steps of providing the exhaust passageway liner, surrounding the exhaust passageway liner with an evaporable foam pattern to form a pattern and liner assembly, and utilizing the pattern and liner assembly in a lost foam casting process wherein the pattern is replaced by a material to form the engine block assembly.

A principal feature of the invention is the provision of an economical and easy method for casting a housing and insert assembly using a lost foam casting process. Since the pattern and insert assembly used in the method can be constructed of multiple pattern sections joined together around an insert, the assembly is easily adaptable to casting simple or complex castings containing intricate or simple inserts. Additionally, the method of the present invention and the pattern and insert assembly can be readily adapted to form virtually any desired housing and insert assembly.

Other features and advantages of the invention will become apparent to those skilled in the art upon review of the following detailed description, claims and drawings.

DESCRIPTION OF THE DRAWINGS

FIG. 1 is a sectional view of a portion of a pattern and insert assembly embodying various features of the invention.

FIG. 2 is a view taken along line 2—2 in FIG. 1.

FIG. 3 is a view taken along line 3—3 in FIG. 1.

FIG. 4 is a sectional view of a portion of a first engine embodying various features of the invention.

FIG. 5 is a sectional view of a portion of a second engine embodying various features of the invention.

Before one embodiment of the invention is explained in detail, it is to be understood that the invention is not limited in its application to the details of the construction and the arrangements of components set forth in the description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Illustrated in FIG. 1 is a portion of a pattern and insert assembly 10 which is employed in a lost foam casting process to produce a cast housing having a cast-in-place insert and which embodies various features of the invention. In the illustrated construction the pattern and insert assembly 10 is configured for use in producing a cylinder or engine block for a two cycle, two cylinder internal combustion engine of a type used in an outboard motor (not shown). However, it should be understood that the pattern and insert assembly 10 can be variously configured for use in producing engine blocks of various types and sizes having various kinds of inserts and for virtually any application.

The pattern and insert assembly 10 comprises a pattern 12 made of an evaporable foam material which is suited for use in a lost foam casting process. The pattern 12 is configured substantially identically to the corresponding engine block to be cast therefrom. Hence, the pattern 12 and the corresponding engine block will be referred to interchangeably.

The pattern 12 can be a single piece structure or can be constructed of a plurality of separate pieces or sections. In the illustrated arrangement (see FIG. 2) the pattern 12 is constructed of a pair of pattern sections 14 and 16 which are assembled together and joined or glued in position along joints 18.

As in the corresponding engine block, the assembled pattern 12 includes an interior exhaust passage wall 20 defining an exhaust passageway 22. A plurality of standoff members or projections or support teats 24 formed integrally with the exhaust passage wall 20 extend inwardly into the exhaust passageway 22. For reasons set forth more fully below, the teats 24 are preferably distributed evenly over the surface of the exhaust passage wall 20 and include contact faces 26. Furthermore, the teats 24 preferably have circular cross sections. The pattern 12 also includes a sealing or mating surface 28 having an opening 30 communicating with the exhaust passageway 22, a coolant or water jacket cavity 32 to facilitate conduction of coolant through the engine block to be formed, cylinder bores 34, and exhaust ports 36 communicating between the cylinder bores 34 and the exhaust passageway 22.

The pattern and insert assembly 10 also comprises an insert 38 which in the illustrated arrangement forms an exhaust passageway liner. The liner 38 is generally tubular or hollow and is captured by or enclosed within the pattern 12 and positioned within the exhaust passageway 22. The liner 38 is generally configured to conform to the contour of the exhaust passage wall 20, and the outer periphery of the liner 38 is engaged by the contact faces 26 of the teats 24 to support the liner 38 within the exhaust passageway 22 and in inwardly spaced relation to the exhaust passage wall 20 so as to provide a gap or space 40 between the liner 38 and the exhaust passage wall 20. The space 40 forms a barrier or boundary between the liner 38 and the exhaust passage wall 20 and functions as an insulating cavity to insulate hot exhaust gases flowing through the engine block from the water cooled exhaust passage wall 20 and accommodates thermal expansion and contraction of the liner 38. Thus, the liner 38 provides a thermal shield which together with the space 40 both insulates the exhaust gases flowing through the engine block and reduces the thermal shock to which the engine block and other engine components are subjected during engine start up or shut down.

While the liner 38 can be constructed of various materials arranged in one or more layers, in the illustrated arrangement the liner 38 is of single layer construction and is made of a material having a melting temperature which is higher than that of the material used to form the engine block. It is preferred that the liner material have a melting temperature which is sufficiently high to avoid melting or weakening by the heat of the exhaust gases or by the molten metal used to form the cast engine block.

The liner 38 includes exhaust port openings 42 adjacent the exhaust ports 36 to receive exhaust gases from the cylinder bores 34, and an outlet opening or end 44 adjacent the opening 30 for discharging the exhaust gases. The opening 30 and the mating surface 28 are designed to cooperate with the outlet end 44 of the liner 38 to provide a smooth transition between the passage defined by the hollow liner 38 and mating components which provide an extension of the exhaust passageway 22, as best shown in FIGS. 4 and 5 and as explained below.

While in the illustrated arrangement the pattern and insert assembly 10 is configured to produce an engine block having a cast-in-place exhaust passageway liner 38, it should be understood that other pattern and insert assemblies can be designed and constructed for use in producing virtually any type of housing having a cast-in-place insert for use in various applications.

Formation of the engine block using the pattern and insert assembly 10 begins with providing the prefabricated liner 38 and surrounding the liner 38 with the pattern sections 14 and 16. This is accomplished by assembling the pattern sections 14 and 16 around the liner 38 and gluing the pattern sections 14 and 16 together at the joints 18. While it is preferred that the pattern sections 14 and 16 be assembled around the liner 38 to surround the liner 38, in other methods an insert can be surrounded by inserting the insert directly into a one-piece or preassembled pattern, or the pattern can be molded around the insert.

After the pattern and insert assembly 10 is formed the assembly 10 is used in a lost foam casting process wherein the evaporable foam making up the pattern 12 is replaced by molten metal which is allowed to solidify to form the engine block in which the liner 38 is cast in place. While various materials can be used to form the engine block, in the illustrated arrangement the engine block is cast of aluminum. Replacement of the foam pattern 12 with the molten aluminum is accomplished by distributing or packing molding sand (not shown) around the pattern and insert assembly 10 so that the molten metal is confined to the area occupied by the pattern 12. Accordingly, the voids and cavities of the pattern and insert assembly 10 including the space 40, the cylinder bores 34, the water jacket cavity 32, the exhaust ports 36, and the interior of the hollow liner 38 are filled with sand before casting. The spaced apart teats 24 facilitate the distribution of sand throughout the space 40 and minimize the contact area between the molten metal and the periphery of the liner 38 to reduce the chilling effect of the liner 38 on the molten metal. After the pattern and insert assembly 10 is packed in the molding sand the engine block is cast by supplying molten metal to replace the evaporable foam pattern 12.

Illustrated in FIG. 4 is a sectional view of a portion of an engine 48 which is part of an outboard motor (not shown) and which includes an engine block 50 and a liner 52 formed by using a pattern and insert assembly including the liner 52 in a lost foam casting process. As described above, the liner 52 is supported in the exhaust passageway 54 of the engine block 50 and includes an outlet end 56 adjacent an opening 58 in a surface 60 of the engine block 50.

The engine 48 also includes an adaptor 62 having a surface 64 mating with the surface 60 of the engine block 50. The adaptor 62 includes an interior passage 64 which serves as an extension of the exhaust passageway 54. The outlet end 56 of the liner 52 is positioned slightly above the joint formed by the mating surfaces 60 and 64 to accommodate thermal expansion of the liner 52, and the interior passage 64 is sized to match the dimensions of the outlet end 56 of the liner 52. Accordingly, the opening 58 in the mating surface 60 of the engine block 50 is somewhat enlarged relative to the interior passage 66 of the adaptor 62 to accomplish a smooth transition from the outlet end 60 of the liner 52 to the passage 66.

Illustrated in FIG. 5 is a sectional view of an engine block 70 having an exhaust passage wall 72 defining an exhaust passageway 72 and a surface 76 having therein an opening 78. The engine block 70 also includes a liner 80 disposed in the exhaust passageway 74 and having an outlet end 82 spaced above the surface 76 of the engine block 70. Thus, it is not necessary to obtain a proper seal between the insert 80 and a surface (not shown) mating with the surface 78. The seal is between the surface 74 and the mating surface.

Other features and advantages of the invention are set forth in the following claims.

We claim:

1. A pattern and insert assembly comprising an insert having opposite ends, and an evaporable foam pattern assembly surrounding said insert, being formed by a plurality of sections joined together around said insert, and including an interior wall having thereon a plurality of spaced projections supporting said insert, spacing said insert from said wall so as to form between said insert and said wall a cavity, and affording filling of said cavity with sand when said pattern and insert assembly is utilized in a lost foam casting process, both of said opposite ends of said insert being spaced from said pattern assembly such that sand can flow into said cavity at both of said ends of said insert.

2. An assembly as set forth in claim 1 wherein each of said projections has a generally circular cross section.

3. An assembly as set forth in claim 1 wherein said pattern sections are joined together with a glue.

4. A method for casting an engine block assembly for a two-cycle engine, said assembly including a cylinder block having a cylinder bore, an exhaust port communicating with said cylinder bore, and an interior passage which communicates with said exhaust port and which is defined by a wall which has thereon a plurality of projections, and an exhaust passageway liner surrounded by said cylinder block and supported in said interior passage by said projections and in inwardly spaced relation to said interior passage wall so as to form between said exhaust passageway liner and said interior passage wall an exhaust gas insulating cavity, said method comprising the steps of providing said exhaust passageway liner, providing a plurality of evaporative foam pattern sections respectively including at least one projection extending from a wall, engaging the exhaust passageway liner, and spacing the exhaust passageway liner from the interior passage wall, assembling said pattern sections around said exhaust passageway liner to form a pattern and liner assembly with said projections in spaced relation to afford filling of the space between the interior passage wall and the exhaust passageway liner with molding sand during embedding of the pattern and liner assembly in molding sand, joining said pattern sections together, and utilizing said pattern and liner assembly in a lost foam casting process wherein said pattern is replaced by a molten material to form said engine block assembly.

5. A method as set forth in claim 4 wherein said cylinder block is fabricated of a first material and said exhaust passageway liner is fabricated of a second material having a melting temperature higher than the melting temperature of said first material.

6. A method as set forth in claim 4 wherein said cylinder block has first and second cylinder bores and first and second exhaust ports respectively communicating with said first and second cylinder bores, wherein said interior passage communicates with both of said exhaust ports, and wherein said liner has therein first and second exhaust port openings respectively communicating with said first and second exhaust ports, and has an outlet opening spaced from said first and second exhaust port openings.

7. A method as set forth in claim 6 wherein said liner is spaced from said pattern sections at each of said first and second exhaust port openings and said outlet opening of said insert such that sand can flow between the interior passage wall and the exhaust passageway liner at, each of said first and second exhaust port openings and said outlet opening.

8. A pattern and insert assembly comprising an insert having a longitudinal axis, and an evaporable foam pattern assembly surrounding said insert, being formed by a plurality of sections joined together at a parting line and around said insert, and including an interior wall having thereon spaced projections supporting said insert, spacing said insert from said wall so as to form between said insert and said wall a cavity, and affording filling of said cavity with sand when said pattern and insert assembly is utilized in a lost foam casting process, and said projections including a plurality thereof being located in a single plane perpendicular to said longitudinal axis and being parallel and perpendicular to said parting line.

9. An assembly as set forth in claim 8 wherein said insert has opposite ends, and wherein both of said opposite ends of said insert are spaced from said pattern assembly such that sand can flow into said cavity at both of said ends of said insert.

10. An assembly as set forth in claim 8 wherein each of said projections has a generally circular cross section.

11. An assembly as set forth in claim 8 wherein said pattern sections are joined together with a glue.

* * * * *

UNITED STATES PATENT AND TRADEMARK OFFICE

CERTIFICATE OF CORRECTION

PATENT NO. : 5,372,176

DATED : December 13, 1994

INVENTOR(S) : Brown, et al.

It is certified that error appears in the above—identified patent and that said Letters Patent is hereby corrected as shown below:

On the cover page, insert item [73],

Assignee: OUTBOARD MARINE CORPORATION
Waukegan, Illinois

Signed and Sealed this

Twenty-ninth Day of August, 1995

Bruce Lehman

*Attest:*

BRUCE LEHMAN

*Attesting Officer*

*Commissioner of Patents and Trademarks*